United States Patent [19]

Ide et al.

[11] Patent Number: 4,601,965

[45] Date of Patent: Jul. 22, 1986

[54] PHOTOSENSITIVE MATERIAL FOR USE IN ELECTROPHOTOGRAPHY

[75] Inventors: Yukio Ide, Mishima; Seiichi Ohseto, Numazu, both of Japan

[73] Assignee: Ricoh Co., Ltd., Tokyo, Japan

[21] Appl. No.: 458,093

[22] Filed: Jan. 14, 1983

[30] Foreign Application Priority Data

Jan. 19, 1982 [JP] Japan ..... 57-6230

[51] Int. Cl.[4] ..... G03G 5/082

[52] U.S. Cl. ..... 430/85; 430/95; 252/501.1

[58] Field of Search ..... 430/95, 85; 252/501.1

[56] References Cited

U.S. PATENT DOCUMENTS

| | | | |
|---|---|---|---|
| 3,077,386 | 2/1963 | Blakney et al. | 423/508 |
| 3,685,989 | 8/1972 | Galen | 430/85 |
| 4,370,399 | 1/1983 | Ghosh et al. | 430/58 |
| 4,518,671 | 5/1985 | Misumi et al. | 430/84 |

FOREIGN PATENT DOCUMENTS

| | | | |
|---|---|---|---|
| 54-009931 | 1/1979 | Japan . | |
| 57-45551 | 3/1982 | Japan | 430/95 |
| 619026 | 3/1979 | U.S.S.R. | 430/95 |

*Primary Examiner*—John E. Kittle
*Assistant Examiner*—José G. Dees
*Attorney, Agent, or Firm*—Flynn, Thiel, Boutell & Tanis

[57] ABSTRACT

A photosensitive material for use in electrophotography having a chargeability improved by incorporating 1 to 500 ppm As oxide in a Se-As (As: 20 to 40% by weight) system photosensitive layer.

3 Claims, No Drawings

PHOTOSENSITIVE MATERIAL FOR USE IN ELECTROPHOTOGRAPHY

BACKGROUND OF THE INVENTION

The present invention relates to a Se-As system photosensitive material for use in electrophotography.

Generally speaking, up to now there have been widely used electrophotographic photosensitive materials of the type which comprises an electrically conductive substrate made from aluminum or the like and a photoconductive layer formed thereon by vacuum vapordepositing selenium or selenium system alloy on said substrate. This is because selenium system photosensitive materials exhibit collectively excellent characteristics such as, for instance, photoconductivity, durability and the like. Particularly, Se-As system photosensitive materials have attracted public attention because of their superior light sensitivity to light of the long wavelength region and the like.

In this regard, there are various factors that exert influence upon the characteristics of these photosensitive materials. Among them, however, it is the oxygen present as-dissolved in the raw materials therefor that exerts a most great influence upon said characteristics.

In other words, the more the dissolved oxygen that is present, the more the residual potential increases to thereby exert a great influence upon the copied image quality. Due to this, various steps such as, for instance, vacuum distillation and the like have been taken in order that the dissolved oxygen may be removed to the utmost.

It is surely preferable to take the aforesaid steps when the raw material for the preparation of the photosensitive material is pure Se or Se-Te system alloy.

However, when the raw material therefor has a composition resembling the Se-As system, in particular $As_2Se_3$, the removal of said dissolved oxygen causes the charged potential tend to dissipate and even if charged successfully, it brings about an increase in the dark decay.

On the contrary, when the amount of said dissolved oxygen increases more than is needed, the photosensitive material is liable to fatigue, like the pure Se or Se-Te system photosensitive material, with the result that the residual potential increases. When a dissolved oxygen-rich alloy is vacumm vapordeposited, the resulting photosensitive material surface is liable to have projections and thus its outward appearance becomes poor.

SUMMARY OF THE INVENTION

The object of the present invention is to solve the aforesaid problems, and the inventors have carried out a series of inventigations thereby to accomplish the present invention.

In other words, the electrophotographic photosensitive material according to the present invention is characterized by the incorporation of 1 to 500 ppm As oxide in the Se-As (As: 20 to 40% by weight) system photosensitive layer.

As is added in order to enhance the thermal stability and sensitivity of the pure Se photosensitive material, while when As oxide is added particularly in the case where the percentage of As in the Se-As system photosensitive layer is in the range of 20 to 40% by weight, proper melt viscosity and vapor rate can be attained, thereby obtaining a photosensitive material with little projections on its surface and accordingly a good outward appearance. In addition, this permits the improvement in charge potential and reduction in dark decay.

The amount of As oxide added is in the range of 1 to 500 ppm, preferably in the range of 1 to 200 ppm. When said amount is less than 1 ppm, charged potential tends to dissipate and thus dark decay increases, while when said amount is more than 500 ppm, the photosensitive material is liable to fatigue, the residual potential increases and further projections are easily formed on the photosensitive material surface.

The incorporation of this As oxide is effected in the manner of doping in the Se-As alloy prior to vapordeposition onto the substrate or treating the photosensitive layer after vapordeposition. The latter can be achieved by subjecting the photosensitive layer to the light oxidizing reaction of $As_2Se_3$ as shown, for instance, in the following formula or applying corona charge to the photosensitive layer in the atmosphere:

$$As_2Se_3 \xrightarrow[\text{or}]{h\nu + kT,\ e^- + kT} XAs + As_{2-x}Se_3 \quad (1)$$

$$\downarrow O_2$$

$$4As + 3O_2 \longrightarrow 2As_2O_3 \quad (2)$$

(wherein, h represents Planck's constant, $\nu$ represents frequency, $e^-$ represents corona charge, k represents rate constant and T represents temperature. Formula (1) illustrates the excited state and Formula (2) illustrates oxidation reaction.)

The $As_2O_3$ incorporated in the photosensitive layer thus forms a surface barrier layer thereby to improve the chargeability.

In this connection, it is to be understood that the object of the present invention can be achieved when an intermediate layer (Se, $Se_x$-$Te_{1-x}$ or the like) is interposed between the substrate and the Se-As photosensitive layer or an element other than oxygen is present in the Se-As photosensitive layer.

DESCRIPTION OF THE PREFERRED EMBODIMENT

An alloy for use in the present invention was obtained by placing 36 parts by weight of As and 64 parts by weight of Se in a glass ampoule, further adding 40 ppm of $As_2O_3$ thereto, vacuum-sealing the same, and thereafter dissolving it at 650° C. for 5 hours. In addition, control sample alloys (1) and (2) were prepared by omitting the addition of $As_2O_3$ and adding 700 ppm of $As_2O_3$ respectively.

Next, the respective alloys were vacuum-vapordeposited onto Al substrates according to the following procedure, thereby obtaining the photosensitive material according to the present invention and the control photosensitive materials:

(1) An Al substrate drum, 120 $\phi$mm × 400 mm in each dimension, was rinsed with perchloroethylene (120° C.).

(2) Next, this was subjected to alkali-etching for 60 seconds in an aqueous 5 wt.% $Na_3PO_4$ solution (80° C.) and then was rinsed twice.

(3) In succession, it was subjected to surface-drying with hot air (80° C.), set in a vapordeposition kettle and exhausted up to $10^{-5}$ Torr.

(4) Further, the above mentioned alloy was vapordeposited on the substrate for 35 minutes under the conditions: vapordeposition source temperature 400° C. and substrate temperature 200° C., thereby obtaining a photosensitive material having a film thickness of 60 μm.

The surfaces of the thus obtained photosensitive material were charged with electricity at room temperature for about 30 minutes under the condition: negative corona discharge current value $-0.35\ \mu A/cm^2$.

The $As_2O_3$ after charge up was measured in respect of concentration and chargeability. The measured results are as shown in Table 1.

TABLE 1

| | $As_2O_3$ concentration (ppm; after the charge up) | Charged potential (V) | Residual potential (V; during repetition) |
|---|---|---|---|
| Example 1 | 55 | 850 | <70 |
| Comparative Example 1 | <1 | <500 | <70 |
| Comparative Example 2 | 750 | <1000 | 150< |

[wherein, the $As_2O_3$ concentration was estimated by means of FTIR (Fourier's transformation infrared absorptiometer).]

It was found from the aforegoing that the photosensitive material (Example 1) according to the present invention was excellent collectively and very high in practicability because the charged potential was high, the residual potential during repetition was low and stable, and the building-up characteristic and sensitivity (light decay) were extremely superior so that no projections were formed on the surface. In contradiction to this, it was found that the photosensitive material according to Comparative Example 1 was low in charged potential and large in dark decay, and the photosensitive material according to Comparative Example 2 was unfit for use because the residual potential increases with the progress of repetition and further projections were generated on the surface.

What is claimed is:

1. A photosensitive material for use in electrophotography, which comprises a Se-As photosensitive layer containing from 20 to 40% by weight of As, said photosensitive layer having incorporated therein from 1 to 500 ppm of As oxide.

2. A photosensitive material according to claim 1 wherein the content of As oxide is in the range of 1 to 200 ppm.

3. A photosensitive material according to claim 1 wherein the As oxide is $As_2O_3$.

* * * * *